US011555353B2

(12) United States Patent
Cammack et al.

(10) Patent No.: US 11,555,353 B2
(45) Date of Patent: Jan. 17, 2023

(54) PULSE POWER DRILLING CONTROL

(71) Applicant: Halliburton Energy Services, Inc., Houston, TX (US)

(72) Inventors: Matthew Eugene Cammack, Houston, TX (US); Boguslaw Wiecek, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 88 days.

(21) Appl. No.: 17/125,643

(22) Filed: Dec. 17, 2020

(65) Prior Publication Data

US 2022/0195807 A1 Jun. 23, 2022

(51) Int. Cl.
*E21B 7/24* (2006.01)
*E21B 7/15* (2006.01)

(52) U.S. Cl.
CPC . *E21B 7/24* (2013.01); *E21B 7/15* (2013.01)

(58) Field of Classification Search
CPC ..... E21B 7/15; E21B 7/24; E21B 47/00
See application file for complete search history.

(56) References Cited

U.S. PATENT DOCUMENTS

2015/0083491 A1* 3/2015 Moeny ..... H03H 7/38 307/112
2016/0010450 A1* 1/2016 Donderici ..... E21B 49/00 175/45
2018/0148981 A1* 5/2018 Moeny ..... E21B 17/003
2020/0217140 A1* 7/2020 Liu ..... E21B 7/15

FOREIGN PATENT DOCUMENTS

JP 2004008861 A 1/2004
WO 2019245544 A1 12/2019

OTHER PUBLICATIONS

PCT Application No. PCT/US2021/053772, International Search Report, dated Jan. 26, 2022, 4 pages.
PCT Application No. PCT/US2021/053772, Written Opinion, dated Jan. 26, 2022, 4 pages.

* cited by examiner

*Primary Examiner* — David Carroll
(74) *Attorney, Agent, or Firm* — Delizio, Peacock, Lewin & Guerra

(57) ABSTRACT

Methods and system for controlling downhole pulse power operation are disclosed. A method may include detecting a pulse signal discharged between pulse power drilling (PPD) electrodes and determining an arc characteristic of the pulse signal. The method may further include adjusting pulse power applied to the PPD electrodes based, at least in part, on the determined arc characteristic of the pulse signal.

20 Claims, 7 Drawing Sheets

PULSE POWER DRILLING CONTROL

BACKGROUND

The disclosure generally relates to pulse power drilling operations including controlling power input during pulse power cycles for pulse power drill head electrodes.

Pulse power drilling entails using electrical pulsing in which a high-power electrical discharge is periodically emitted into the formation for drilling. The process includes transmission of high energy/power that is generated, stored, and periodically electrically discharged as pulses by a downhole pulse generator. Electrodes disposed on a pulse power drill head at the bottom of a pulse power drilling string emit the electrical discharges into the subsurface formation rock.

Each discharge is designed to generate a high energy fluid in the form of a plasma in formation material at the bottom surface of a borehole. The plasma is a highly conductive, ionized gas containing free electrons and resultant positive ions from which the electrons have been disassociated. The injected energy carried by the plasma is expended as a mechanical fracturing force by heating the formation fluids within the formation material. In this manner, the high-energy discharges generate high internal pressure with rock material to fracture the rock by internal tension.

To effectively and efficiently implement pulse power drilling, the energy discharged from a pulse power drill head must generate sufficient rock fracturing effect per unit energy discharged. The rock fracturing effectiveness therefore depends on the efficiency of energy transfer from the drill head into the rock as well the properties of the formation material. The efficiency of energy transfer is determined by several factors including distance between the point of discharge on the drill head surface (i.e., electrode surface) and the formation material surface. For each pulse, some or all of the discharged electric current travels between pulser bit electrodes as a plasma arc. The breakdown voltage resulting in plasma arcing is set at a level at which plasma arcing is maximized when an electrode or pair of electrodes are effectively in contact with the formation material. A portion of the pulse discharge current may travel from one or both of the electrodes into the formation without reaching the other electrode in a non-arcing phenomenon. The portion of the plasma power expended as non-arcing does not result in appreciable current transfer between bit electrodes, thus reducing drilling efficiency.

To efficiently drill using pulse power, the electrodes on the pulse power drill head must generally be in substantial contact with the bottom of the borehole. Contact may be lost during drilling such as during periods in which the drill string is slightly raised in between active drilling interval such as for borehole cleaning. The relative closeness of contact between the drill head electrodes and bottom surface of the borehole may also vary during active drilling for a variety of reasons such as obstruction of the bottom by cuttings debris thus affecting drilling and power consumption efficiency and component wear.

BRIEF DESCRIPTION OF THE DRAWINGS

Aspects of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. In other instances, well-known instruction instances, protocols, structures and techniques have not been shown in detail in order not to obfuscate the description.

Disclosed embodiments include methods, systems, and components for maintaining modulating or otherwise controlling the pulse power operation based on signal characteristics of pulse discharges during and/or between downhole drilling operations. Disclosed embodiments also include methods, systems, and components for implementing pulse power control by using a communication channel between controllers in which signal levels for pulse cycles are monitored and configured by the controllers to encode and decode pulse control instructions that are selected based on signal profiles of discharged pulses.

Example Illustrations

Figure 1:
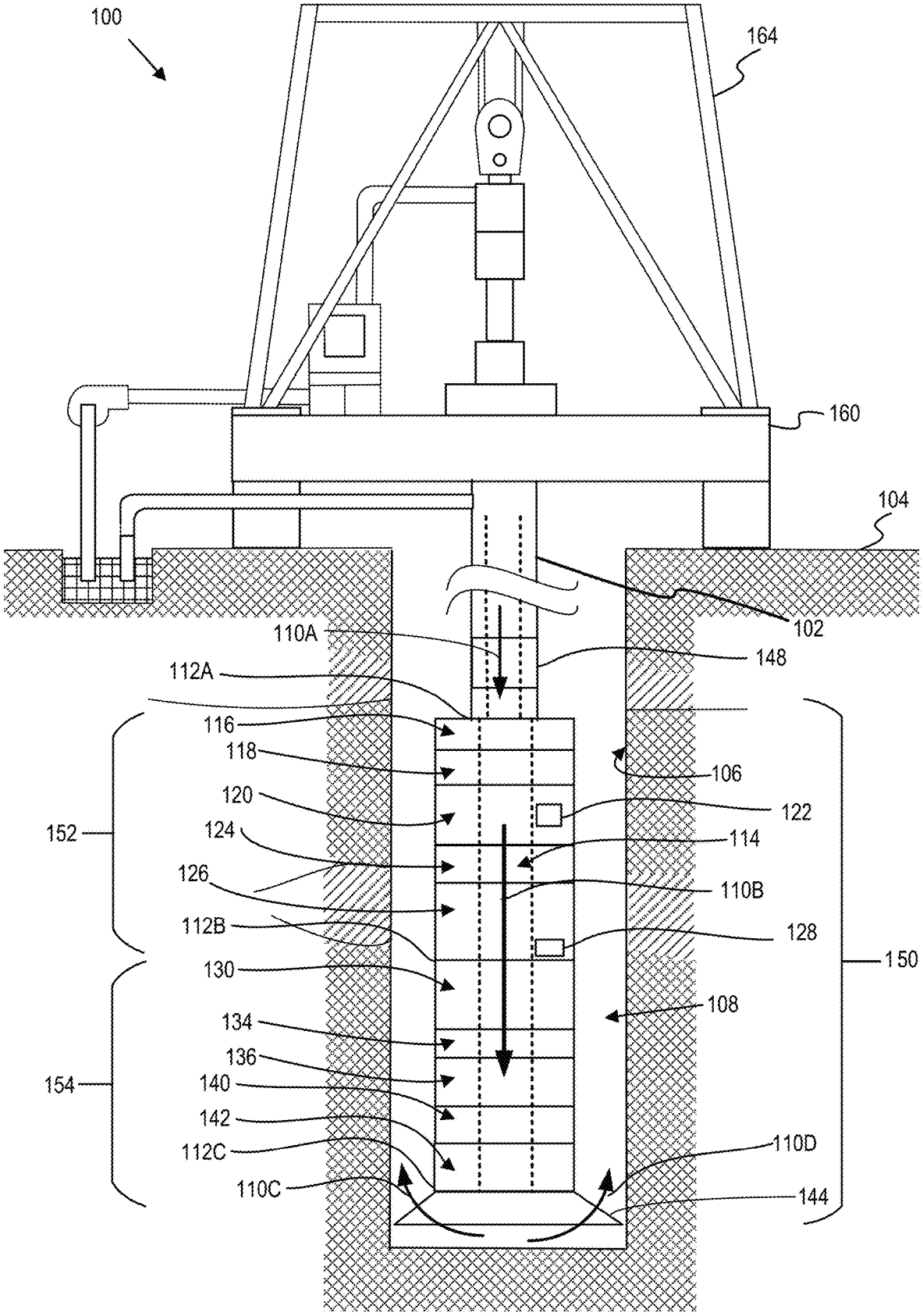
FIG. 1 is a block diagram depicting a pulse power drilling system in accordance with some embodiments.

FIG. 1 illustrates an example pulse power drilling (PPD) apparatus 100, including a PPD assembly 150 positioned in a borehole 106 and secured to a length of drill pipe 102 coupled to a drilling platform 160 and a derrick 164. PPD assembly 150 is configured to further the advancement of borehole 106 using pulse electrical power generated by PPD assembly 150 and provided to electrodes 144 in a controlled manner to break up or otherwise fracture formation material of a subsurface formation along the bottom face of borehole 106 and in the nearby proximity to electrodes 144.

The flow of drilling fluid 110A within drill pipe 102 is provided from the drilling platform 160, and flows to and through a turbine 116, exiting turbine 116 and flowing into other sub-sections or components of PPD assembly 150. The flow of drilling fluid 110A through turbine 116 causes turbine 116 to mechanically rotate. This mechanical rotation is coupled to an alternator 118 sub-section or component of the assembly to generate electrical power. Alternator 118 can further process and controllably provide electrical power to the rest of PPD assembly 150. The power output is stored as electrical energy within charge storage components such as a bank of primary capacitors 136 and a bank of secondary capacitors 142. The stored energy can then be applied to and output from electrodes 144 as periodic electrical discharges to drill borehole 106.

The drilling fluid flows through PPD assembly 150, as indicated by arrow 110B, and flows out and away from electrodes 144 and back toward the surface to aid in the removal of the debris generated by the breaking up of the formation material at and nearby electrodes 144. The fluid flow direction away from electrodes 144 is indicated by arrows 110C and 110D. In addition, the flow of drilling fluid may provide cooling to one or more devices and to one or more portions of PPD assembly 150. In various embodiments, it is not necessary for PPD assembly 150 to be rotated as part of the drilling process, but some degree of rotation or oscillations of PPD assembly 150 may be provided in various embodiments of drilling processes utilizing PPD assembly 150, including internal rotations occurring at the turbine 116, in the alternator sub-section, etc.

As illustrated in FIG. 1, PPD assembly 150 includes multiple sub-assemblies, including in some embodiments turbine 116 at a top of PPD assembly 150 where the top is a face of PPD assembly 150 furthest from a drilling face of PPD assembly 150 that contains the electrodes 144. Turbine 116 is coupled to multiple components including alternator 118, a rectifier 120, a rectifier controller 122, a direct current (DC) link 124, a DC to DC booster 126, a generator controller 128, a pulse power controller 130, a switch bank 134 that includes one or more switches 138, one or more primary capacitors 136, a transformer 140, one or more secondary capacitors 142, and electrodes 144.

PPD assembly 150 can be divided into a generator 152 and a pulse power section 154. Generator 152 may include turbine 116, alternator 118, rectifier 120, rectifier controller 122, DC link 124, DC to DC booster 126, and generator controller 128. Pulse power section 154 may include pulse power controller 130, switch bank 134, primary capacitors 136, transformer 140, secondary capacitors 142, and electrodes 144. Components can be divided between generator 152 and pulse power section 154 in other arrangements, and the order of the components can be other than as shown. PPD assembly 150 may comprise multiple sub-sections, with a joint used to couple each of the sub-sections together in a desired arrangement. Field joints 112A-C can be used to couple generator 152 and pulse power section 154 to construct PPD assembly 150 and to couple PPD assembly 150 to the drill pipe 102. Embodiments of PPD assembly 150 may include one or more additional field joints coupling various components of PPD assembly 150.

The drilling fluid 110A passing through turbine 116 continues to flow through one or more sections of a center flow tubing 114 that provides a flow path through one or more components of PPD assembly 150. The portion of the flow is depicted as drilling fluid 110B positioned between the turbine 116 and the electrodes 144, as indicated by the arrow pointing downward through the cavity of center flow tubing 114. Once arriving at a drill head on which electrodes 144 are mounted, the flow of drilling fluid is expelled out from one or more ports or nozzles located in or in proximity to the drill head. After being expelled from PPD assembly 150, the drilling fluid flows back upward toward the surface through an annulus 108 created between PPD assembly 150 and the walls of borehole 106.

PPD apparatus 100 may include one or more logging tools 148. Logging tools 148 are shown as being located on drill pipe 102, above PPD assembly 150, but may also be included within PPD assembly 150 or joined via shop joint or field joint to assembly 150. Logging tools 148 may include one or more logging while drilling (LWD) or measurement while drilling (MWD) tools, including resistivity, gamma-ray, nuclear magnetic resonance (NMR), etc. PPD apparatus 100 may also include directional control, such as for geosteering or directional drilling, which can be part of PPD assembly 150, logging tools 148, or located elsewhere on drill pipe 102.

Communication from pulse power controller 130 to the generator controller 128 allows pulse power controller 130 to transmit data about and modifications for pulse power drilling to generator 152. Similarly, communication from generator controller 128 to pulse power controller 130 allows generator 152 to transmit data about and modifications for pulse power drilling to the pulse power section. Pulse power controller 130 is configured to control the discharge of the stored pulse energy stored for emissions out from electrodes 144 and into the formation, into drilling mud, or into a combination of formation and drilling fluids. Pulse power controller 130 can measure data about the electrical characteristics of each of the electrical discharges—such as power, current, and voltage emitted by electrodes 144. Based on information measured for each discharge, pulse power controller 130 can determine information about drilling and about electrodes 144, including whether or not the electrodes 144 are firing into the formation (i.e., drilling) or firing into the formation fluid (i.e., electrodes 144 are off bottom). Generator 152 can control the charge rate and charge voltage for each of the multiple pulse power electrical discharges. Generator 152, together with turbine 116 and alternator 118, can create an electrical charge in the range of 16 kilovolts (kV) which pulse power controller 130 delivers to the formation via electrodes 144.

In response to communication from pulse power controller 130 encoded and transmitted as described herein, generator 152 may modify charging metrics such as charge rate and charge amplitude based on electrical discharge characteristics and changes thereto detected at pulse power controller 130. Because the load on turbine 116, alternator 118, and generator 152, and electrodes 144 is large, modifying the charging metrics in response to the communicated instructions from pulse power controller 130 may protect generator 152 and associated components from load stress and can extend the lifetime of components of the pulse power drilling assembly. Modulating the charging metrics in this manner may also enable more efficient drilling operation, for example, in terms of optimizing necessary breakdown voltages during drilling in a variable parameter environment (e.g., changing temperature, differing lithology properties, etc.).

For instances in which PPD assembly 150 is off bottom, electrical power input to the system may be at least partially absorbed by the drilling fluid, which can be vaporized, boiled off, or destroyed because of the large power load transmitted in the electrical pulses. In these and additional cases, communications or messages between pulse power controller 130 and generator 152 allow the entire assembly to vary charge rates and voltages, along with other adjustments depicted and described herein. Especially where pulse power controller 130 and generator 152 are autonomous, i.e., not readily in communication with the surface, downhole control of PPD assembly 150 can improve pulse power drilling function.

Figure 2:
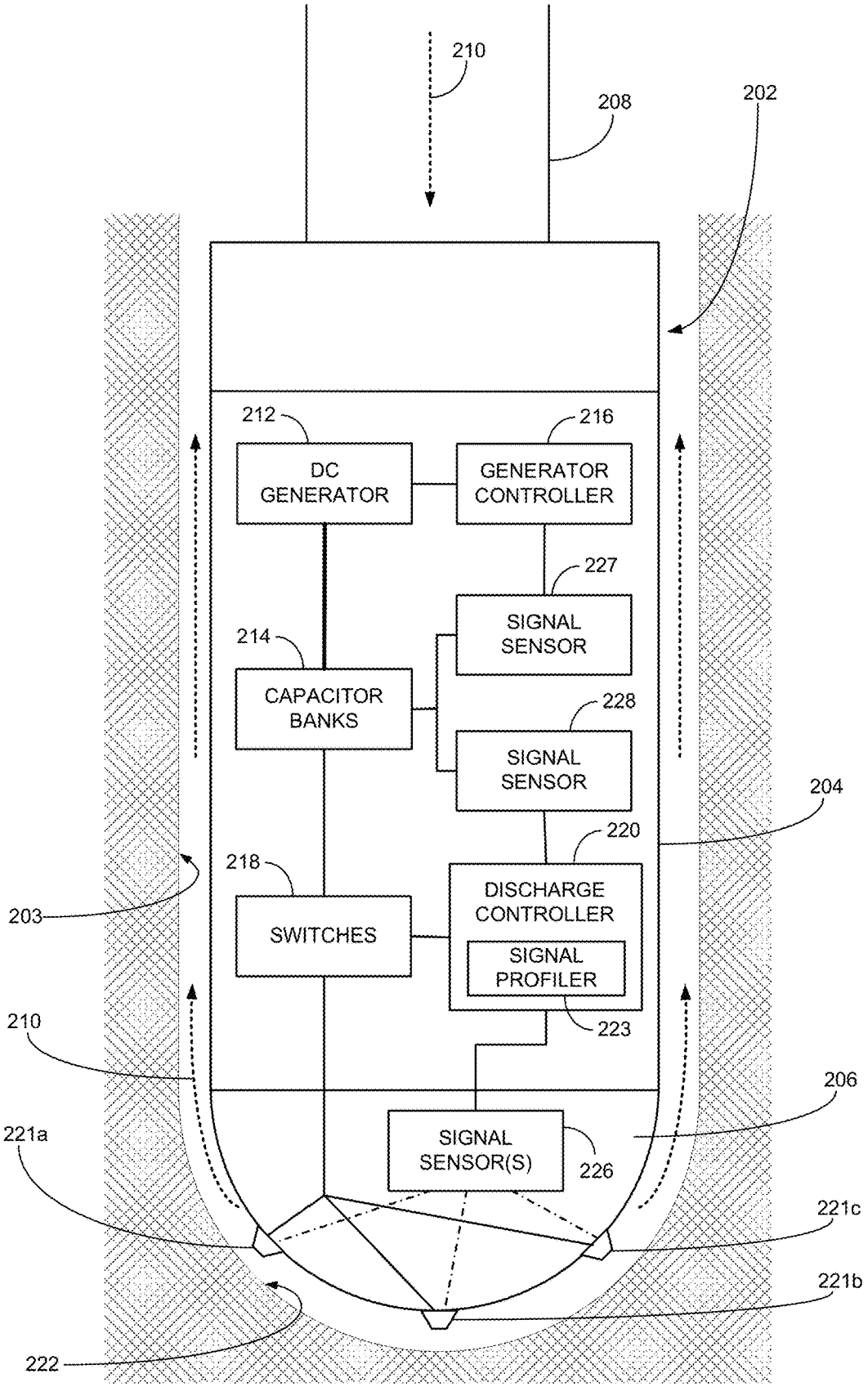
FIG. 2 is a block diagram illustrating a pulse power bottom hole assembly configured in accordance with some embodiments.

FIG. 2 is a block diagram illustrating a lower end of a drill string that includes a PPD assembly in accordance with some embodiments. The systems and components depicted in FIG. 2 may be implemented in the PPD apparatus shown in FIG. 1. The lower end of the drill string includes a pulse power bottom hole assembly (BHA) 202 coupled to a section of drill pipe 208 and is disposed in proximity to the bottom surface 222 of a borehole wall 230. BHA 202 includes a PPD assembly comprising a pulse generator 204 and a pulse power drill head 206 that are cooperatively configured to generate and discharge high-power electric discharges during drilling operations.

BHA 202 includes systems and components configured to generate, store, and transmit the electric pulses to electrodes disposed on the surface of pulse power drill head 206. For example, the electrical energy generation and storage components within BHA 202 include a DC generator 212 that is coupled with capacitor banks 214. DC generator 212 may be configured similarly to generator 152 in FIG. 1 and include, for example, turbine, alternator, and rectifier components for generating electrical energy to be stored by capacitors within capacitor banks 214. For embodiments in which electrical energy is generated in situ via a turbine, the flow of drilling fluid 210 drives the turbine which in turn actuates rotation in the alternator. In some embodiments, electrical power is supplied to the PPD assembly from the surface, via one or more wires or via wired pipe. Integrated with or otherwise coupled with DC generator 212 is a generator controller 216. Generator controller 216 is configured using any combination of electronic components, processor hardware, and program code for controlling operation of the components within DC generator 212. For example, generator controller 216 may include a microprocessor and storage media such as memory in which instructions are encoded and executed by the microprocessor to implement the operations described in the depicted embodiments.

For each pulse, the charge/energy generated by DC generator 212 is stored by capacitors within capacitor banks 214. To effectuate a pulse discharge, the stored charge is released by operation of a set of switches 218 as determined by a discharge controller 220. When actuated (e.g., closed), the switches instantly apply the stored charge voltage to the electrodes such as electrodes 221*a*-221*c* on drill head 206. Discharge controller 220 may include or be incorporated in pulse power controller 130 depicted in FIG. 1. Discharge controller 220 is configured using any combination of electronic components, processor hardware, and program code for controlling the discharge timing for each of the sequence pulses enabling a controlled sequence of discharges from the electrodes. For example, discharge controller 220 may include a microprocessor and storage media such as memory in which instructions are encoded and executed by the microprocessor to implement the operations described in the depicted embodiments In some embodiments, drill head 206 includes a central tip electrode such as electrode 221*b* and multiple azimuthally distributed electrodes such as electrodes 221*a* and 221*c*. To effectuate discharge, the electrodes are configured into pairs in various configurations such as electrodes 221*a* and 221*b* forming a pair and electrodes 221*c* and 221*b* forming a pair. The electrodes are electrically connected via switches 218 and other intermediate conductors to the respective low voltage (e.g., ground) and high voltage (e.g., stored positive or negative charge level) to form the anode cathode pairs required for pulse discharge.

During active drilling and/or between active drilling cycles it may be useful to regulate pulse generation metrics such as pulse discharge rate and amplitude of the pulses. Unnecessary energy consumption and tool wear may occur during periods in which BHA 202 is lifted from bottom surface 222 and the portion of each discharged pulse that is expended as arcing is substantially reduced. For example, BHA 202 may be slightly or moderately lifted during routine drill operation cycling or based on downhole conditions such as debris buildup. Regulation of the pulse generation metrics may also be useful for optimizing drilling efficiency in terms of rate of penetration, for example.

The depicted PPD assembly further includes components within pulse generator 204 and drill head 206 configured to modulate or otherwise control generating and discharging of pulses during downhole operations. In some embodiments, the signal profiles for pulse discharges are detected and analyzed to determine arcing characteristics indicative of a pulse in which a plasma arc was or was not formed between an electrode pair. Based on the arc characteristic of a pulse signal, a pulse power metric such as pulse rate and or pulse amplitude may be adjusted by pulse generator 204.

Figure 3A:
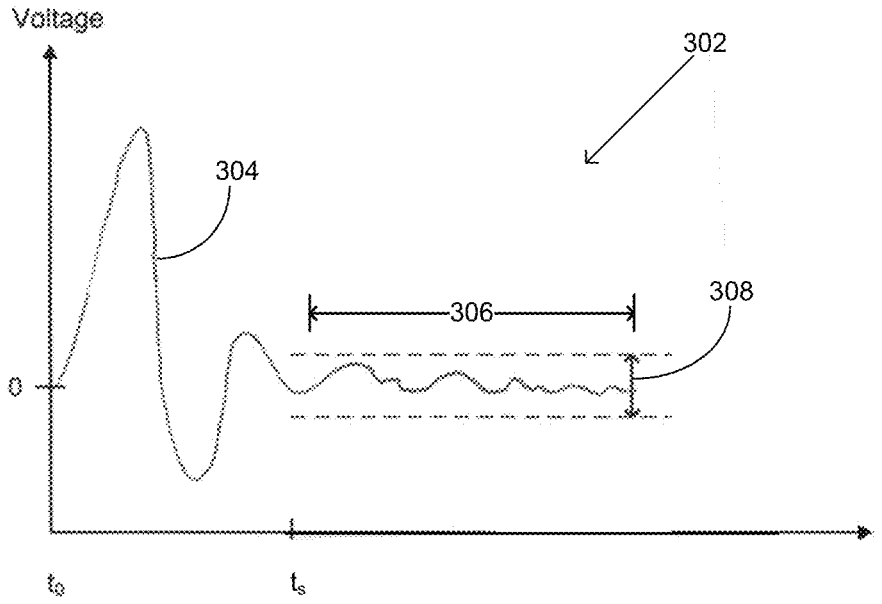
FIG. 3A depicts a detected pulse signal that may be processed to determine arc characteristics in accordance with some embodiments.
Figure 3B:
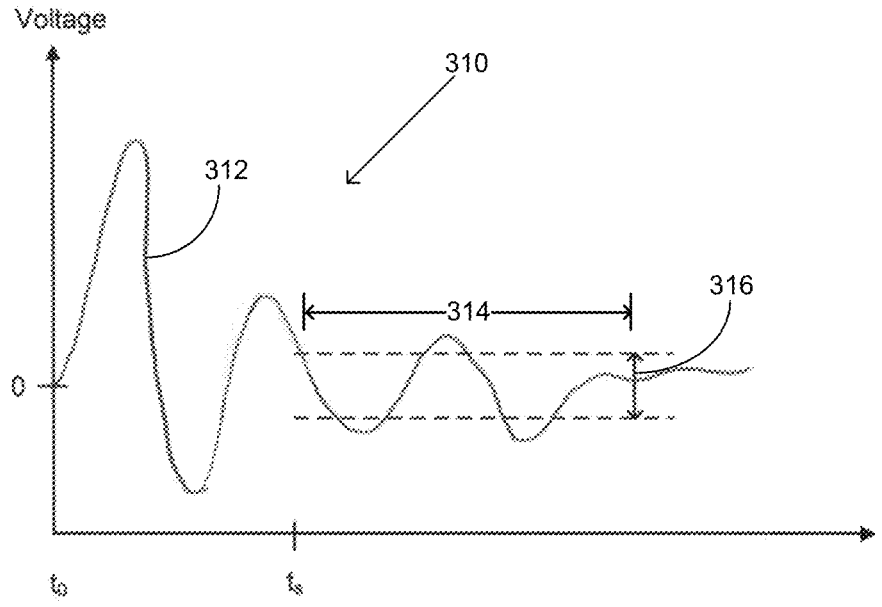
FIG. 3B depicts a detected pulse signal that may be processed to determine arc characteristics in accordance with some embodiments.

The PPD assembly includes a set of signal sensors 226 configured to detect pulse discharges from and between electrodes pairs. Signal sensors 226 may comprise voltage sensors and or current sensors disposed within drill head 206 or pulse generator 204 and coupled with the electrodes. Signal sensors 226 are configured to detect pulse signals such as pulse signals 302 and 310 depicted in FIGS. 3A and 3B, respectively. As shown in FIGS. 3A and 3B, pulse signals 302 and 310 include respective pulse portions 304 and 312 and settling portions 306 and 314. The pulse signal information detected by signal sensors 226 may be processed internally or externally to the sensors by one or more digital signal processor that translate or otherwise condition the measured voltage/current signal into digital information that may be programmatically processed.

The signal information corresponding to the detected pulses is provided to a pulse signal profiler 223 that may be incorporated within discharge controller 220 or otherwise communicatively coupled therewith. Signal profiler 223 is configured using any combination of program code and data to determine arc characteristics of the detected pulse signals. The arc characteristics indicate whether and/or to what extent a given pulse discharge successfully achieved dielectric breakdown, generating a substantial plasma arc between PPD electrodes. In some embodiments, signal profiler 223 is configured to determine an arc characteristic of a pulse signal by determining an amount or proportion of the pulse signal that was transferred between PPD electrodes that is indicative of a substantial plasma arc.

In some embodiments, signal profiler 223 determines the electrode pair pulse energy transfer by analyzing peak amplitudes at various points within a pulse signal. For example, FIG. 3A depicts detected pulse signal 302 that may be processed by signal profiler 223 to determine arc characteristics. Pulse signal 302 includes initial pulse portion 304 and subsequent settling portion 306. Signal profiler 223 may be configured to classify pulse signal 302 as indicating a substantial plasma arc or a failure to arc based on the amplitude of pulse portion 304. For example, signal profiler 223 may classify pulse signal 302 as indicating a substantial arc in response to determining that the amplitude of pulse portion 304 exceeds a specified threshold value. Conversely, signal profiler 223 may classify pulse signal 302 as indicating absence of a substantial arc in response to determining that the amplitude of pulse portion 304 is less than the threshold value. Additionally or in the alternative, signal profiler 223 may classify pulse signal 302 based on amplitude analysis of settling portion 306. Ringing is a phenomenon in which a pulse or other abrupt signal results in subsequent oscillation noise that may have a significant amplitude when a pulse discharge fails to achieve arcing. For embodiments in which measurement of ringing is utilized to classify a pulse signal, signal profiler 223 may be configured to detect ringing based on the amplitudes of the signal during the settling portion of the signal. For example, signal profiler 223 may apply a specified peak-to-peak amplitude threshold to the setting portion of a pulse signal to classify as indicating a substantial arc or lack of arcing. For example, FIG. 3B depicts pulse signal 310 having a settling portion 314 that includes peaks that exceed an error band 316. Settling portion 314 may therefore be classified as indicating a lack of arc. In contrast, the settling portion 306 of pulse signal 302 remains within an error band 308 and therefore may be classified as indicating an arc.

In some embodiments, signal profiler 223 is configured to detect, measure, or otherwise determine the proportion of a pulse signal that is transferred between electrodes (i.e., determine arcing or lack thereof) by using pattern matching. For example, signal profiler 223 may include or have access to a library of pulse signal shapes corresponding to various levels of arcing and lack of arcing. Signal profiler 223 may apply a pattern matching algorithm to determine a pattern match between a detected pulse and a signal shape profile that indicates an arc or lack of arcing.

Having determined an arc characteristic (e.g., arc, no arc, proportion/percent arc, etc.) of a pulse signal, pulse generator 204 is further configured to control further pulse power operation accordingly. The depicted PPD assembly includes additional systems and components configured to determine whether and in what manner to modify pulsing operation including aspects of charging capacitor bank 214. Regardless of the manner of arc characterization, discharge controller 220 is configured to determine whether and in what manner to modify pulsing operations based on the characterization or a set of characterizations determined over multiple pulse discharges. In some embodiments, discharge controller 220 includes coded instructions and data configured to select pulse modification instructions based on the arc characterization(s). The PPD assembly further includes systems and components configured to provide communication such as between discharge controller 220 and generator controller 216 to implement pulsing operation and/or modifications to pulsing operations by leveraging pulse generation and discharge infrastructure.

In some embodiments, the PPD assembly implements a communication channel between discharge controller 220 and generator controller 216 using sensed voltage levels into or on capacitor banks 214. To this end, pulse generator 204 includes signal sensors 227 and 228, each configured to sense voltage or current levels into or on capacitor banks 214. While signal sensors 227 and 228 may be implemented as distinct, physically separate components, they may be combined as a single or otherwise unified a single sensor in alternate embodiments. As depicted, signal sensor 227 is communicatively connected to and provides the voltage/current values detected for capacitor banks 214 to generator controller 216. Signal sensor 228 is communicatively connected to and provides the voltage/current values detected for capacitor banks 214 to discharge controller 220. In this manner, generator controller 216 and discharge controller 220 simultaneously receive instantaneous voltage/current information that effectively communicates the state of pulsing operation at any instant in time.

Figure 4:
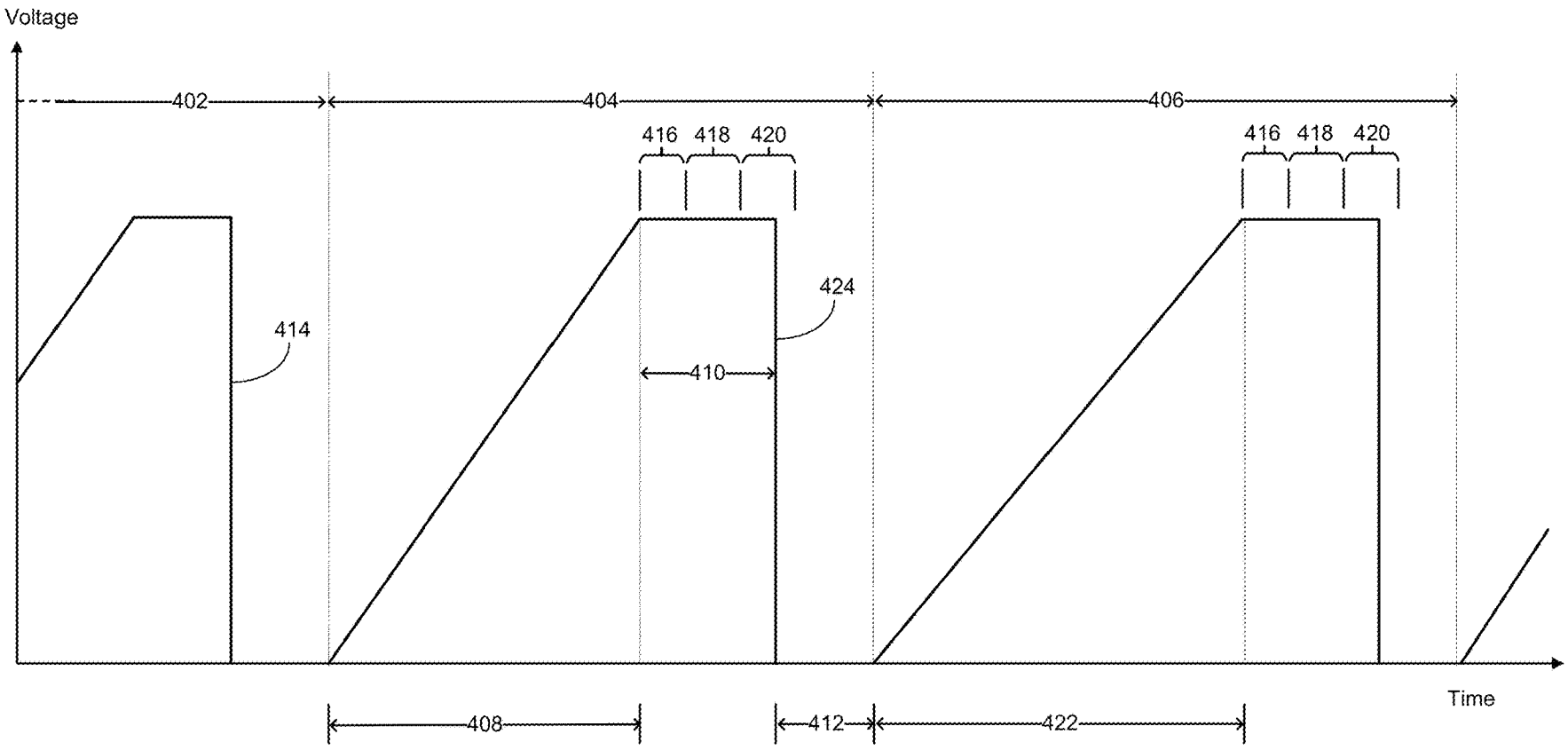
FIG. 4 is a signal diagram illustrating pulse cycles as may be monitored and configured by a pulse generator as an information encoding and decoding mechanism to implement pulsing control in accordance with some embodiments.

FIG. 4 is a signal diagram illustrating pulse cycles 402, 404, and 406 as may be monitored and utilized by generator controller 216 and discharge controller 220 as an information encoding and decoding mechanism to implement pulsing control. Referring to FIG. 2 in conjunction with FIG. 4, a pulse cycle 404 begins with both discharge controller 220 and generator controller 216 detecting the start of a charge phase 408 based on a detected voltage/current rise monitored by sensors 227 and 228 following a pulse discharge 414. Discharge controller 220 has determined an arc characterization for the pulse discharged during pulse cycle 402 and has selected a charge instruction corresponding to the characterization. Following full charge at the end of charge phase 408 detected via signal sensor 228, discharge controller 220 encodes and communicates the instruction during a pre-pulse delay phase 410 following charge phase 408. The instruction is detected and decoded by generator controller 216 by monitoring the voltage levels such as by signal sensor 227. More specifically, the depicted embodiment implements time bin coding in which each instruction is coded within one of a range of multiple time bins that span the variable pre-pulse delay phase for each pulse cycle. For example, the depicted range of time bins for the pre-pulse delay phases of the pulse cycles includes time bins 416, 418, and 420.

Some of the time bins may be accuracy buffers and each of the others corresponds to a respective pulse metric modification such as a modification to the charging rate/time and or the charge level of capacitor banks 214. For instance, time bin 416 may be a minimum time delay bin, time bin 418 may correspond to an instruction to increase the charge rate (decrease charge time), and time bin 420 may correspond to an instruction to decrease the charge rate (increase charge time). Minimum delay bin 416 or another time bin (not depicted) may correspond to an instruction to maintain the current pulse metrics. Having selected a time bin that corresponds to the selected instruction, discharge controller 220 encodes the instruction by implementing a pulse discharge 424 via switches 218 within the selected bin 420. Generator controller 216 decodes the instruction by determining the period between the completion of charge phase 408 and the time of pulse discharge 424 by monitoring the voltage levels sensed by signal sensor 227. For example, generator controller 216 detects termination of upward ramping voltage levels or may detect a particular charge level as indicating the end of charge phase 408.

Generator controller 216 tracks the period between the end of charge phase 408 and pulse discharge 424 such as via an internal clock to identify the time bin and corresponding pulse metric modification instruction. Responsive to the instruction, generator controller 216 modifies pulsing such as by increasing or decreasing charge rate accordingly. In the depicted embodiment, generator controller 216 responds to the instruction by implementing a next pulse cycle 406 in which DC generator 212 begins charging capacitor banks 214 following a post-pulse delay and charging at a decreased charge rate (charge time increased) as illustrated by charge phase 422.

Figure 5:
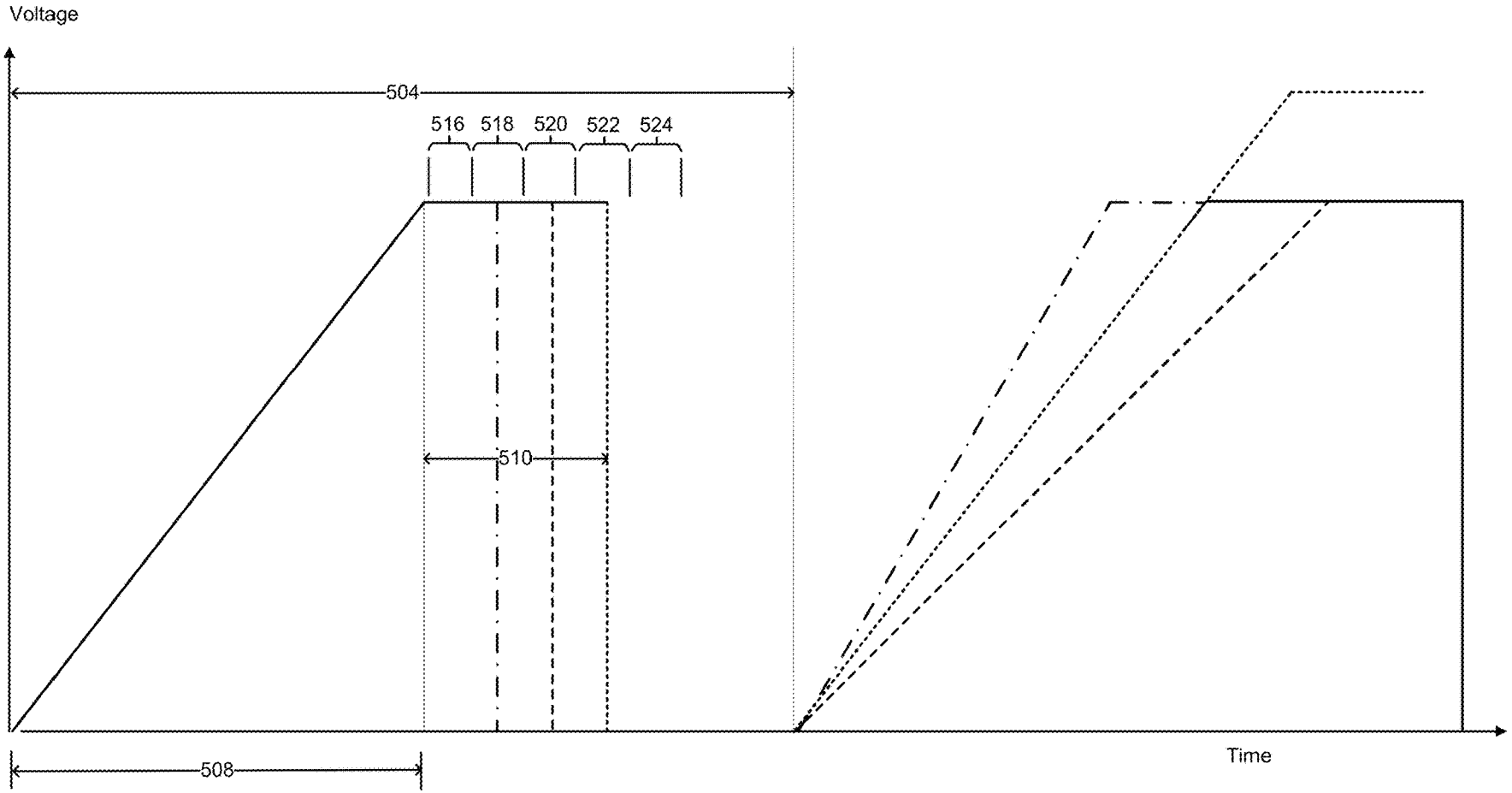
FIG. 5 is a signal diagram illustrating pulse cycles as may be monitored and utilized by a pulse generator as an information encoding and decoding mechanism to implement pulsing control in accordance with some embodiments.

Alternative time bin coding schema may be utilized in accordance with various embodiments. FIG. 5 is a signal diagram illustrating implementation of time bin (instruction bin) coding that may be utilized to control multiple different pulse metrics including charging rate and charge level. As shown, a pulse cycle 504 includes a charge phase 508 and a pre-pulse delay phase 510 in which a pulsing modification instruction is encoded using multiple time bins. The range of time bins includes a minimum delay time bin 516 and instruction time bins 518, 520, 522, and 524. As depicted by the corresponding coded lines between multiple possible pulse discharges, either the charge rate/time is modified or the charge level for the subsequent pulse cycle is modified based on the charge instruction corresponding to the time bin within which a discharge controller discharges the pulse.

Figure 6:
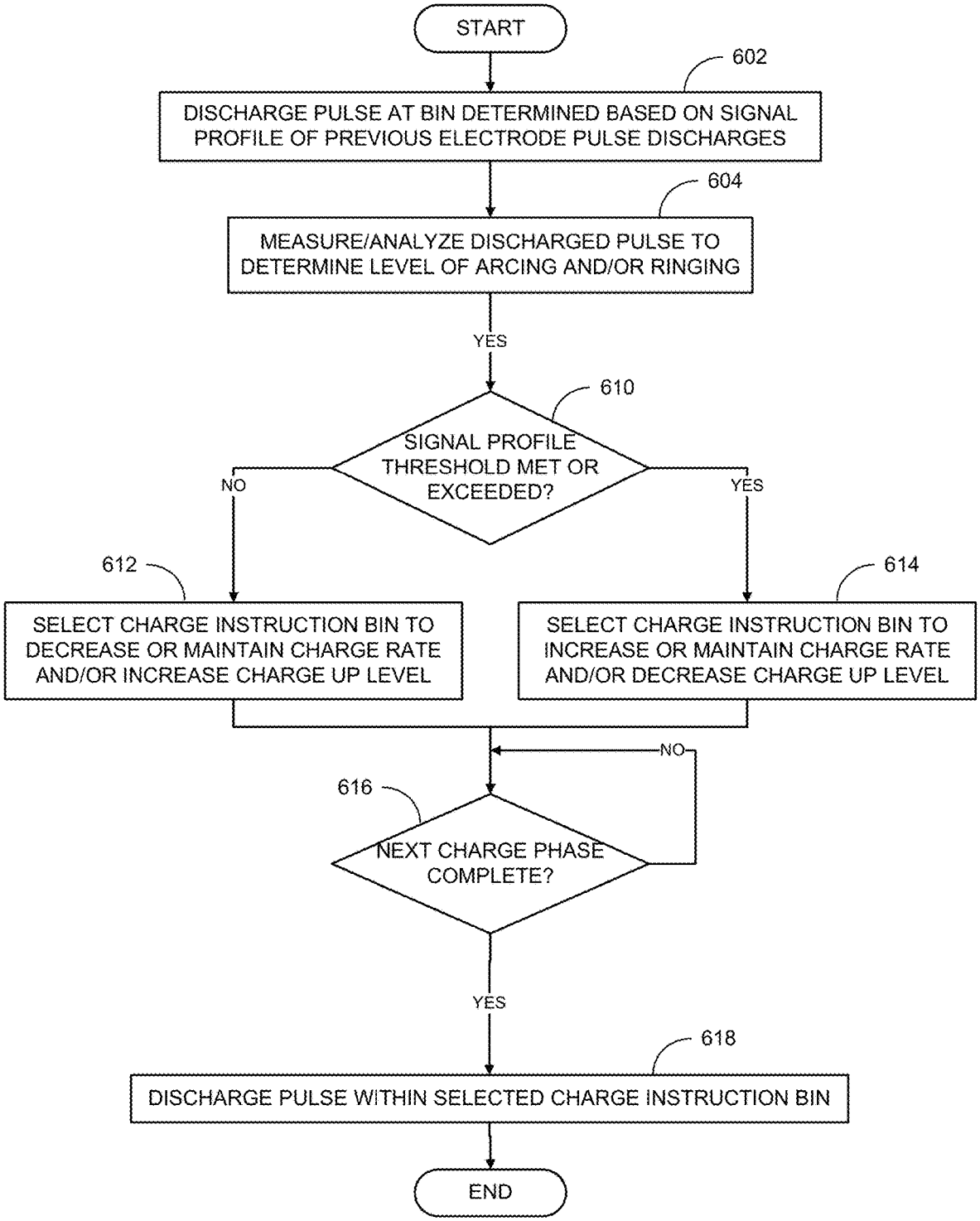
FIG. 6 is a flow diagram depicting operations and functions for determining and communicating pulsing operations including adjustments to pulse metrics based on one or more previous pulse discharge signal profiles in accordance with some embodiments.

FIG. 6 is a flow diagram depicting operations and functions for determining and communicating whether to modify a pulse metric based on one or more previous pulse discharge signal profiles. The operations and functions may be implemented by systems and components depicted and described with reference to FIGS. 1-5. The process begins as shown at block 602 with a discharge controller, such as discharge controller 220, discharging a pulse within a time bin corresponding to a charging instruction selected by the discharge controller based on an arc characteristic of one or more previous discharge pulses. At block 604, a signal sensor detects the pulse discharged at block 602 between PPD electrodes and transmits the pulse signal information to a signal profiler. The signal profiler processes the pulse signal information to determine an arc characteristic of the pulse signal. In some embodiments, the arc characteristic may comprise a level (e.g., percent, proportion) of arcing indicated by the pulse signal.

In some embodiments, the signal profiler may determine the level of arcing by determining a proportion of a pulse signal transferred between the PPD electrodes. Determining the proportion of the pulse signal transferred may include determining a proportion of the pulse signal transferred between PPD electrodes as a plasma arc. Determining the proportion of the pulse signal transferred may also include determining a pattern match between the pulse signal and a signal shape profile to determine whether the pulse signal corresponds to a plasma arc. The arc characteristic may also be determined based on whether substantial ringing is determined in the pulse signal such as by determining a level of ringing in the pulse signal.

At inquiry block 610, the signal profiler, discharge controller, or other component determines whether the determined level of arcing and/or ringing indicates substantial plasma arcing based on a threshold. As shown at block 612, in response to determining that the level of arcing and/or ringing does not indicate substantial plasma arcing, the discharge controller selects a charge instruction to decrease or maintain the charge rate and/or increase the charge level for a bank of capacitors from which pulses are applied to PPD electrodes. As shown at block 614, in response to determining that the level of arcing and/or ringing indicates substantial plasma arcing, the discharge controller selects a charge instruction to increase or maintain the charge rate and/or maintain or decrease the charge level for the capacitor bank. The charge instruction selected at either block 612 or block 614 corresponds to one of a range of selectable time bins during a pre-pulse delay phase. In response to detecting that a charge phase of the current pulse cycle is complete, the discharge controller discharges a pulse to the PPD electrodes at a time within a pre-pulse delay phase determined by the selected time bin (block 618).

Figure 7:
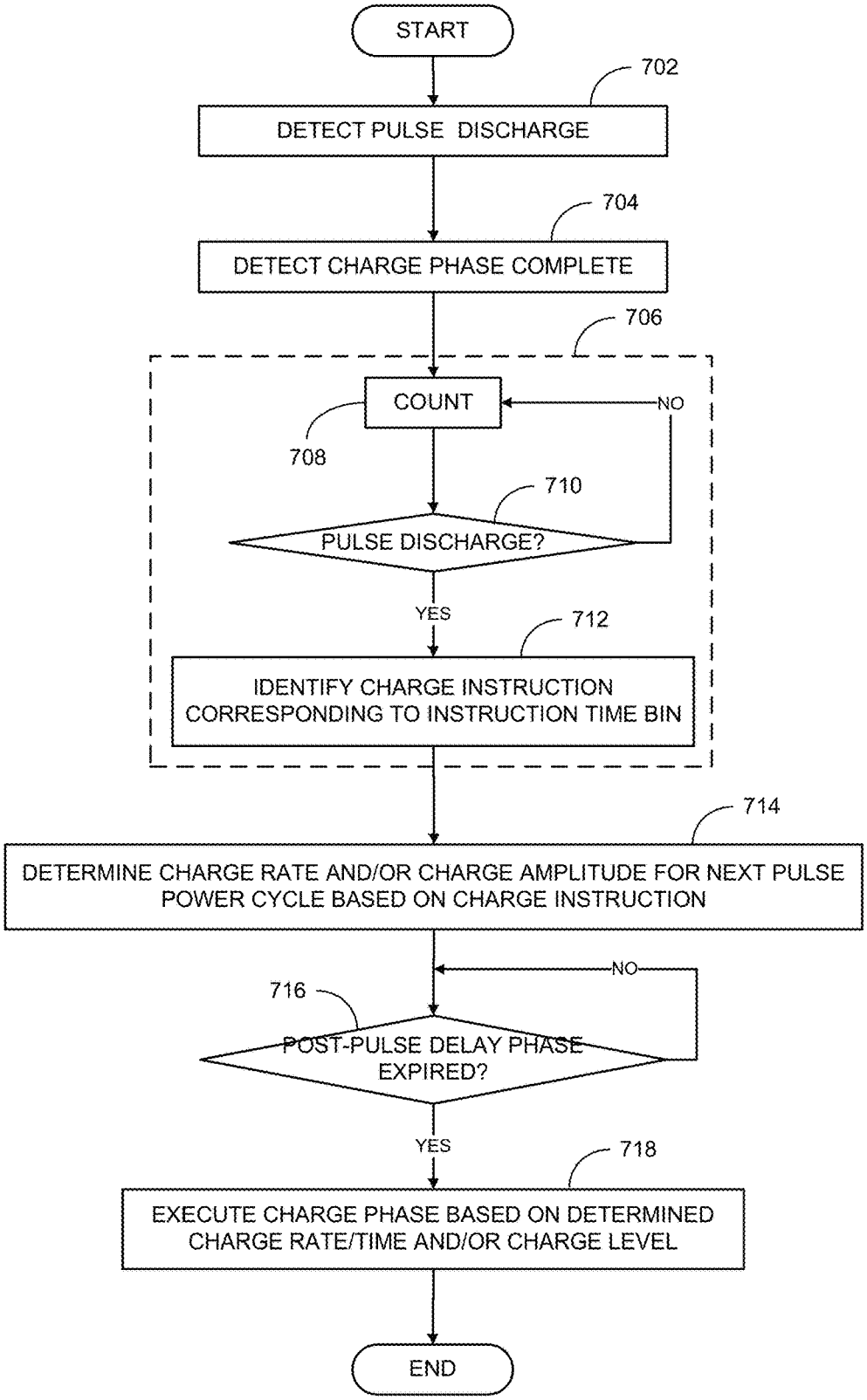
FIG. 7 is a flow diagram illustrating operations and functions for adjusting charge rate/time and/or charge level based on charge cycle instructions in accordance with some embodiments.

FIG. 7 is a flow diagram illustrating operations and functions for adjusting charge rate/time and/or charge level based on charge cycle instructions in accordance with some embodiments. The operations and functions may be implemented by systems and components depicted and described with reference to FIGS. 1-6. The process begins as shown at block 702 with a generator controller detecting a pulse discharged from PPD electrodes. Following the pulse discharge and possibly a post-pulse delay, the generator controller charges a bank of capacitors from which pulses are applied to PPD electrodes. At block 704, the generator controller detects or otherwise determines that the charge phase is complete and control passes to superblock 706 in which the generator controller implements an instruction bin detection phase.

During bin detection, the generator controller uses a counter, such as an internal clock, to determine the time length of a pre-pulse delay (block 708). As shown at blocks 710 and 708 counting continues until generator controller detects a pulse discharge based on a voltage or current signal from the capacitor bank. In response to detecting the pulse discharge, the generator controller identifies a charge instruction based on the time bin during the pre-pulse delay phase within which the pulse discharge was detected (block 712). Following bin detection and instruction identification, the pulse cycle may enter a post-pulse delay phase (block 716). In response to expiration of the post-pulse delay phase, the generator controller implements a charge phase in accordance with the charge instruction, such as by increasing, decreasing, or maintaining charge rate/time and/or increasing, decreasing, or maintaining charge level on the capacitor bank.

Variations

While the aspects of the disclosure are described with reference to various implementations and exploitations, it will be understood that these aspects are illustrative and that the scope of the claims is not limited to them. In general, techniques for implementing formation testing as described herein may be performed with facilities consistent with any hardware system or systems. Plural instances may be provided for components, operations or structures described herein as a single instance. Finally, boundaries between various components, operations and data stores are somewhat arbitrary, and operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The machine-readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. Use of the phrase "at least one of" preceding a list with the conjunction "and" should not be treated as an exclusive list and should not be construed as a list of categories with one item from each category, unless specifically stated otherwise.

Example Embodiments

Embodiment 1: A method for controlling downhole pulse power operation, said method comprising: detecting a pulse signal discharged between pulse power drilling (PPD) electrodes; determining an arc characteristic of the pulse signal; and adjusting pulse power applied to the PPD electrodes based, at least in part, on the determined arc characteristic of the pulse signal. Determining an arc characteristic of the pulse signal may comprise determining a proportion of pulse signal transferred between the PPD electrodes. Determining a proportion of pulse signal transferred between the PPD electrodes may comprise determining a proportion of the pulse signal transferred between PPD electrodes as a plasma arc. Determining an arc characteristic of the pulse signal may include: determining a pattern match between the pulse signal and a signal shape profile; and determining an arc proportion of the pulse signal based, at least in part, on the determined pattern match. Determining an arc characteristic of the pulse signal may include: detecting an amplitude of a pulse portion of the pulse signal; and determining an arc proportion of the pulse signal based, at least in part, on the detected amplitude of the pulse portion. Determining an arc characteristic of the pulse signal may include: detecting an amplitude of a ringing portion of the pulse signal; and determining an arcing proportion of the pulse signal based, at least in part, on the detected amplitude of the ringing portion. Adjusting pulse power applied to the PPD electrodes may comprise: determining a modification to a pulse metric; and encoding the modification to the pulse metric within a pre-pulse delay phase of a pulse cycle. Determining a modification to the pulse metric may comprise selecting an increase or a decrease in charging rate for a storage device from which pulses are applied to the PPD electrodes. Determining a modification to the pulse metric may comprise determining a modification to an amplitude of pulses applied to the electrode. Adjusting pulse power applied to the PPD electrodes may comprise: decoding the modification to the pulse metric from the pre-pulse delay phase of the pulse cycle; and modifying charging of a storage device from which pulses are applied to the PPD electrodes based on the decoded modification to the pulse metric. Encoding the modification to the pulse metric may comprise: selecting a time bin that corresponds to an instruction to modify the pulse metric, wherein the time bin is included in a range of time bins for the pre-pulse delay phase; and discharging, within the selected time bin, a pulse from a storage device to the PPD electrodes. Two or more of the time bins may correspond to respective modifications to charging of the storage device. Adjusting pulse power applied to the PPD electrodes may comprise decoding the modification to the pulse metric by detecting the pulse discharge during the time bin.

Embodiment 2: A system for controlling downhole pulse power operation, said system comprising: a signal sensor configured to detect a pulse signal discharged between pulse power drilling (PPD) electrodes; a processor; and a computer-readable medium having instructions stored thereon that are executable by the processor to cause the system to determine an arc characteristic of the pulse signal; and adjust pulse power applied to the PPD electrodes based, at least in part, on the determined arc characteristic of the pulse signal. Determining an arc characteristic of the pulse signal may comprise determining a proportion of pulse signal transferred between the PPD electrodes. Determining a proportion of pulse signal transferred between the PPD electrodes may comprise determining a proportion of the pulse signal transferred between PPD electrodes as a plasma arc. Determining an arc characteristic of the pulse signal may include: determining a pattern match between the pulse signal and a signal shape profile; and determining an arc proportion of the pulse signal based, at least in part, on the determined pattern match. Determining an arc characteristic of the pulse signal may include: detecting an amplitude of a pulse portion of the pulse signal; and determining an arc proportion of the pulse signal based, at least in part, on the detected amplitude of the pulse portion. Determining an arc characteristic of the pulse signal may include: detecting an amplitude of a ringing portion of the pulse signal; and determining an arcing proportion of the pulse signal based, at least in part, on the detected amplitude of the ringing portion. Adjusting pulse power applied to the PPD electrodes may comprise: determining a modification to a pulse metric; and encoding the modification to the pulse metric within a pre-pulse delay phase of a pulse cycle. Determining a modification to the pulse metric may comprise selecting an increase or a decrease in charging rate for a storage device from which pulses are applied to the PPD electrodes. Determining a modification to the pulse metric may comprise determining a modification to an amplitude of pulses applied to the electrode. Adjusting pulse power applied to the PPD electrodes may comprise: decoding the modification to the pulse metric from the pre-pulse delay phase of the pulse cycle; and modifying charging of a storage device from which pulses are applied to the PPD electrodes based on the decoded modification to the pulse metric. Encoding the modification to the pulse metric may comprise: selecting a time bin that corresponds to an instruction to modify the pulse metric, wherein the time bin is included in a range of time bins for the pre-pulse delay phase; and discharging, within the selected time bin, a pulse from a storage device to the PPD electrodes. Adjusting pulse power applied to the PPD electrodes may comprise decoding the modification to the pulse metric by detecting the pulse discharge during the time bin.

The invention claimed is:

1. A method for controlling a downhole pulse power operation, said method comprising:

detecting a pulse signal discharged between pulse power drilling (PPD) electrodes;

determining an arc characteristic of the pulse signal, wherein the arc characteristic of the pulse signal indicates an extent of dielectric breakdown between the PPD electrodes; and adjusting a pulse power applied to the PPD electrodes based, at least in part, on the determined arc characteristic of the pulse signal.

2. The method of claim 1, wherein determining the arc characteristic of the pulse signal comprises determining a proportion of the pulse signal transferred between the PPD electrodes as a plasma arc.

3. The method of claim 1, wherein determining the arc characteristic of the pulse signal includes:

determining a pattern match between the pulse signal and a signal shape profile; and determining an arc proportion of the pulse signal based, at least in part, on the determined pattern match.

4. The method of claim 1, wherein determining the arc characteristic of the pulse signal includes:

detecting an amplitude of a pulse portion of the pulse signal; and determining an arc proportion of the pulse signal based, at least in part, on the detected amplitude of the pulse portion.

5. The method of claim 1, wherein determining the arc characteristic of the pulse signal includes:

detecting an amplitude of a ringing portion of the pulse signal; and determining an arcing proportion of the pulse signal based, at least in part, on the detected amplitude of the ringing portion.

6. The method of claim 1, wherein adjusting the pulse power applied to the PPD electrodes comprises:

determining a modification to a pulse metric; and encoding the modification to the pulse metric within a pre-pulse delay phase of a pulse cycle.

7. The method of claim 6, wherein determining the modification to the pulse metric comprises selecting an increase or a decrease in charging rate for a storage device from which pulses are applied to the PPD electrodes.

8. The method of claim 6, wherein adjusting the pulse power applied to the PPD electrodes comprises:

decoding the modification to the pulse metric from the pre-pulse delay phase of the pulse cycle; and modifying charging of a storage device from which pulses are applied to the PPD electrodes based on the decoded modification to the pulse metric.

9. The method of claim 6, wherein encoding the modification to the pulse metric comprises:

selecting a time bin from a range of time bins that corresponds to an instruction to modify the pulse metric, wherein the selected time bin is included in the range of time bins for the pre-pulse delay phase; and discharging, within the selected time bin, a pulse from a storage device to the PPD electrodes.

10. The method of claim 9, wherein two or more time bins of the range of time bins correspond to respective modifications to charging of the storage device.

11. The method of claim 10, wherein adjusting the pulse power applied to the PPD electrodes comprises decoding the modification to the pulse metric by detecting the pulse discharge during the selected time bin.

12. A system for controlling downhole pulse power operation, said system comprising:

a signal sensor configured to detect a pulse signal discharged between pulse power drilling (PPD) electrodes;

a processor; and a computer-readable medium having instructions stored thereon that are executable by the processor to cause the system to, determine an arc characteristic of the pulse signal, wherein the arc characteristic of the pulse signal indicates an extent of dielectric breakdown between the PPD electrodes; and adjust a pulse power applied to the PPD electrodes based, at least in part, on the determined arc characteristic of the pulse signal.

13. The system of claim 12, wherein the instructions to determine the arc characteristic of the pulse signal comprise instructions to determine a proportion of the pulse signal transferred between the PPD electrodes.

14. The system of claim 13, wherein the instructions to determine the proportion of the pulse signal transferred between the PPD electrodes comprises instructions to determine the proportion of the pulse signal transferred between PPD electrodes as a plasma arc.

15. The system of claim 12, wherein the instructions to determine the arc characteristic of the pulse signal comprise instructions to:

determine a pattern match between the pulse signal and a signal shape profile; and determine an arc proportion of the pulse signal based, at least in part, on the determined pattern match.

16. The system of claim 12, wherein the instructions to determine the arc characteristic of the pulse signal comprise instructions to:

detect an amplitude of a pulse portion of the pulse signal; and determine an arc proportion of the pulse signal based, at least in part, on the detected amplitude of the pulse portion.

17. The system of claim 12, wherein the instructions to determine the arc characteristic of the pulse signal comprise instructions to:

detect an amplitude of a ringing portion of the pulse signal; and determine an arcing proportion of the pulse signal based, at least in part, on the detected amplitude of the ringing portion.

18. The system of claim 12, wherein the instructions to adjust the pulse power applied to the PPD electrodes comprise instructions to:

determine a modification to a pulse metric; and encode the modification to the pulse metric within a pre-pulse delay phase of a pulse cycle.

19. The system of claim 18, wherein the instructions to adjust the pulse power applied to the PPD electrodes comprise instructions to:

decode the modification to the pulse metric from the pre-pulse delay phase of the pulse cycle; and modify charging of a storage device from which pulses are applied to the PPD electrodes based on the decoded modification to the pulse metric.

20. The system of claim 18, wherein the instructions to encode the modification to the pulse metric comprise instructions to:

select a time bin that corresponds to an instruction to modify the pulse metric, wherein the selected time bin is included in a range of time bins for the pre-pulse delay phase; and discharge, within the selected time bin, a pulse from a storage device to the PPD electrodes.

* * * * *